US006582582B2

(12) United States Patent
Becking

(10) Patent No.: US 6,582,582 B2
(45) Date of Patent: Jun. 24, 2003

(54) ELECTROPLATING COMPOSITION AND PROCESS

(76) Inventor: Donald Becking, 138 Tanglewood Dr., Southington, CT (US) 06489

( * ) Notice: Subject to any disclaimer, the term of this patent is extended or adjusted under 35 U.S.C. 154(b) by 174 days.

(21) Appl. No.: 09/803,631

(22) Filed: Mar. 9, 2001

(65) Prior Publication Data

US 2002/0170828 A1 Nov. 21, 2002

(51) Int. Cl.[7] ..... C25D 3/56

(52) U.S. Cl. ..... 205/244; 205/240; 205/241; 205/252; 205/253; 205/254; 205/300; 205/301; 205/302; 205/303; 205/304; 205/305; 205/238; 205/261; 106/1.25; 106/1.16; 106/1.29; 106/1.05

(58) Field of Search ..... 106/1.25, 1.16, 106/1.29, 1.05; 205/240, 241, 244, 252, 253, 254, 300, 301, 302, 303, 304, 305–314, 238, 261

(56) References Cited

U.S. PATENT DOCUMENTS

| | | | | |
|---|---|---|---|---|
| 3,616,306 A | | 10/1971 | Conoby et al. | |
| 3,769,182 A | | 10/1973 | Beckwith et al. | |
| 3,892,637 A | | 7/1975 | Polti | |
| 3,905,878 A | | 9/1975 | Dohi et al. | |
| 4,163,700 A | | 8/1979 | Igarashi et al. | |
| 4,168,223 A | | 9/1979 | Igarashi et al. | |
| 5,118,394 A | * | 6/1992 | Makino et al. | 205/253 |
| 5,618,402 A | | 4/1997 | Sakurai et al. | |
| 5,674,374 A | * | 10/1997 | Sakurai et al. | 205/252 |

FOREIGN PATENT DOCUMENTS

GB 2 266 894 A 11/1993

JP 51075632 A * 6/1976

OTHER PUBLICATIONS

English Abstract of JP 51075632 A published on Jun. 1976.*

Lewis, Hawley's Condensed Chemical Dictionary, 13th Ed., John Wiley & Sons, 1997, no month available.*

Technical Bulletin, DGV SZ–240 & DGV SZ–242, Tin–Zinc Plating Process, Dipsol Gumm Ventures. No date available.

Tin/Zinc Alloy Plating, Jean Rasmussen, Plating & Surface Finishing, Feb. 2001, pp 18–20.

Electroplating of Sn—Zn Alloys from Aqueous Gluconate Baths, S.M. Abdel–Wahab, et al., Metall, May 2000, pp 268–272.

Mechanism of Additive in Electroplating of Sn—Zn Alloy, M. An et al., Plating & Surface Finishing, May 1999, pp 130–132.

Tin–Zinc Plating, Edward Budman, Dipsol Gumm Ventures and David Stevens, Advance Surface Treatments, U.K. 1998, No month avail.

Inventory Expert Service Report, Registry No. 301539–72–0, Propanedioic acid, American Chemical Society. No date available.

* cited by examiner

*Primary Examiner*—Roy King
*Assistant Examiner*—Wesley A. Nicolas
(74) *Attorney, Agent, or Firm*—Carmody & Torrance LLP

(57) ABSTRACT

An electroplating bath is disclosed that is particularly suited to the electrodeposition of tin, zinc and alloys of the foregoing in a smooth and bright electrodeposit. The disclosed electroplating bath comprises propanedioic acid, diethyl ester, polymer with N-(3-aminopropyl)-1,3-propanediamine, N-(2-carboxy benzoyl) as a brightener additive. In addition, the electroplating bath may also comprise carboxylic acids, ammonium salts, aldehyde compounds and a variety of co-brighteners.

32 Claims, No Drawings

ELECTROPLATING COMPOSITION AND PROCESS

BACKGROUND OF THE INVENTION

The present invention relates to an electroplating process and composition capable of depositing tin, zinc, and alloys of each of the foregoing in a smooth, bright deposit. This invention is particularly suited for use in depositing tin-zinc alloys in a smooth, bright deposit from an acidic to neutral plating solution.

The electrodeposition of tin, zinc and alloys of each of the foregoing, has been widely used for both functional and decorative applications. In particular, tin-zinc alloy electrodeposits have been widely used to protect steel and other metals from corrosion and to improve the aesthetic appearance thereof. In general, zinc and zinc alloy electrodeposits have been widely used for corrosion protection of steel and similar metals, while tin and tin alloys have been widely used to promote the solderability of various surfaces.

U.S. Pat. No. 3,769,182 to Beckwith, et al. discusses a tin-lead electroplating solution comprising stannous tin ions, and lead ions in a fluoborate, fluosilicate and/or sulfamate electrolyte with a polyoxyalkylated fatty acid alkylolamide surfactant additive. The solution reportedly operates at pH of less than about 3.0 and produces desirable deposits over a wide range of current densities.

U.S. Pat. No. 3,616,306 to Conoby, et al. discusses an aqueous bath for electroplating tin containing stannous ions, sulfate radical, an imidazoline derivative, a carbinamine compound, and a cyclic aldehyde or ketone brightener. The bath is highly acidic and reportedly operates to produce dense, smooth, bright and adherenent deposits at relatively high current densities.

U.S. Pat. No. 4,168,223 to Igarashi, et al. discusses an electroplating bath, for depositing tin or tin alloys, which contains tin ions, alloy ions (optional), citric acid or its salt, an ammonium salt, and a water soluble epoxy polymer as a brightener. The bath operates at a pH from 4 to 8 and reportedly produces bright deposits of a wide array of tin alloys.

Notwithstanding the availability of a wide variety of different electroplating formulations for the production of zinc, zinc alloy, tin and tin alloy deposits, there remains a need for a composition and process that is capable of producing smooth, bright deposits in an electrically efficient manner and over a wide range of current densities, particularly at high current densities. Although presently known processes are capable of producing electrodeposits with desirable characteristics such as smoothness, uniformity, fine grain structure and reduced porosity, these known processes are frequently not able to reliably deliver these characteristics over a wide range of current densities and with a high degree of plating (electrical) efficiency.

As a result, it is an object of this invention to disclose an electroplating composition and process capable of plating tin, tin alloys, zinc, and zinc alloys, with smooth, bright, adherent electrodeposits, over a wide range of current densities. It is further an object of this invention to disclose an electroplating composition and process that produces a substantially uniform composition of deposit, even if the plating current density fluctuates. Lastly it is an object of this invention to disclose an electroplating composition and process which can plate with high plating efficiency.

SUMMARY OF THE INVENTION

According to this invention, the above objects can be accomplished through use of an electroplating solution comprising:

a. stannous tin and/or zinc ions;

b. carboxylic acid, particularly citric acid, tartaric acid, ascorbic acid, and/or gluconic acid, or salts of carboxylic acids;

c. ammonium salt, particularly ammonium sulfate;

d. propanedioic acid, diethyl ester, polymer with N-(3-aminopropyl)-1,3-propanediamine, N-(2-carboxybenzoyl); and e. optionally, but preferably, an aldehyde compound.

The foregoing composition is employed by contacting the surface to be plated with the electroplating solution. The surface to be plated is made cathodic (negative) and metal, corresponding to the metal ions in solution, which is also in contact with the solution, is made anodic (positive). As a result a bright, smooth adherent metal electrodeposit is formed on the cathode surface when current is applied.

The foregoing process is capable of plating tin, tin alloys, zinc and zinc alloys in a smooth, bright, adherent electrodeposit. The process is especially suited to plating a tin-zinc alloy and will plate a relatively constant alloy (±5% by weight) over a wide current density range of from about 50 to 300 amps per square foot and at plating temperatures up to about 110° F.

DETAILED DESCRIPTION OF THE INVENTION

The inventor herein has discovered that a particularly useful electroplating composition and process for plating tin, tin alloys, zinc and zinc alloys can be provided by contacting the part to be plated with an aqueous electroplating bath comprising:

a. metal ions selected from the group consisting of stannous tin ions, zinc ions, and mixtures of the foregoing;

b. a material selected from the group consisting of carboxylic acids, salts of carboxylic acids, and mixtures of the foregoing;

c. ammonium salt;

d. propanedioic acid, diethyl ester, polymer with N-(3-aminopropyl)-1,3-propanediamine, N-(2-carboxybenzoyl); and e. optionally, an aldehyde compound;

wherein the part to be plated is made cathodic (negative) and anodes comprising metal corresponding to the metal ions in the electroplating bath is also placed in contact with the bath, while current is applied. Preferably the electroplating bath comprises both stannous tin and zinc ions.

Tin ions may be supplied to the electroplating bath upon make-up with a soluble source of stannous tin ions such as stannous sulfate, stannous chloride, stannous methane sulfonate or other similar soluble sources of stannous tin ions. Zinc ions may similarly be supplied to the electroplating bath upon make-up with a soluble source of zinc ions such as zinc sulfate or zinc chloride. Stannous sulfate and zinc sulfate are preferred sources of tin and zinc ions respectively. Preferably, if present, the concentration of tin ions in the electroplating bath range from about 30 to 50 g/l, most preferably from about 35 to 45 g/l. Preferably, if present, the concentration of zinc ions in the electroplating bath range from about 15 to 40 g/l, most preferably from about 20 to 35 g/l. As noted the electroplating composition is particularly effective in plating tin-zinc alloys. In this case, the electroplating bath comprises both tin and zinc ions and the concentration of tin ions preferably ranges from about 30 to 40 g/l while the concentration of zinc ions ranges from about 20 to 40 g/l.

The electroplating bath also comprises carboxylic acid(s) and/or salts of carboxylic acid(s). These carboxylic acids are preferably selected from the group consisting of citric acid, tartaric acid, gluconic acid, ascorbic acid and mixtures of the foregoing. The salts are preferably selected from the group consisting of sodium, potassium, and ammonium salts of citric acid, tartaric acid, gluconic acid, ascorbic acid and mixtures of the foregoing. The concentration of carboxylic acid and/or carboxylic acid salts in the bath may range from about 70 to 120 g/l, but is preferably from about 80 to 100 g/l.

The ammonium salt is added as the base electrolyte. Preferably the ammonium salt is ammonium sulfate. The concentration of the ammonium salt in the electroplating bath may range from about 70 to 180 g/l, but is preferably from about 80 to 120 g/l.

The electroplating bath also comprises a brightener additive having the following chemical structure:

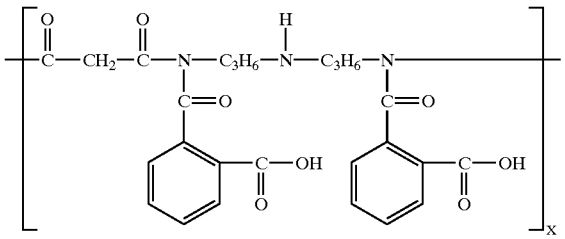

Where X is an integer, preferably an integer from about 2 to 16, most preferably an integer from 3 to 6. The foregoing brightener additive is called propanedioic acid, diethyl ester, polymer with N-(3-aminopropyl)-1,3-propanediamine, N-(2-carboxybenzoyl). This compound is prepared by reacting dipropylene triamine with diethyl malonate on a 1 to 1 molar basis to form a white solid intermediate. The intermediate is then dissolved in dipropylene glycohnethyl ether and phthalic anhydride is added to the mixture as a reactant at a molar ratio of 2 moles of intermediate to one mole of phthalic anhydride. The mixture is heated to 170°–180° C. and then cooled. The resultant solution then contains the brightener additive and can be used as such in the composition of this invention. The concentration of the brightener additive in the electroplating bath may range from about 0.2 to 5 g/l but is preferably from 0.6 to 1.0 g/l (without considering the dipropylene glycol methyl ether solvent).

In addition to the brightener additive, an aldehyde compound may be added as a secondary brightener. Preferably the aldehyde compound is selected from the group consisting of formaldehyde, acetaldeyde, propionaldeyde, glyoxal, succindialdehyde, caproaldehyde, benzaldehyde, p-tolualdehyde, salicyladehyde, anisaldehyde, piperonal, veratrylaldehyde, and vanillin. These aldehyde compounds are not excellent brighteners in the electroplating bath when used by themselves alone but produce synergistic effects when used with the foregoing brightener additive of this invention such that together they provide an excellent brightening effect and a bright electrodeposit. If present, the concentration of aldehyde compounds in the electroplating composition may range from about 0.010 to 0.30 g/l, but is preferably from 0.03 to 0.1 g/l.

Other known leveling agents and co-brighteners may optionally also be added to the electroplating bath. These additional optional additives include polyethylene glycols, water soluble polypropylene oxide polymers, water soluble polyethylene oxide polymers, bis-phenol ethoxylates, alcohol ethoxylates, aromatic ethoxylates, ethoxylated fatty acids, ethoxylated amines, polyglycerines, and various surfactants. Many of the foregoing compounds are useful in providing leveling effects and in otherwise brightening the electroplated deposits. The specific compound to be selected depends upon the specific electroplating bath but the inventor has found the following compounds to be particularly useful in tin, zinc, or tin-zinc electroplating baths: diglycidyl polyethylene glycol, polyglycerine and bis-phenol ethoxylates. In general, if used, the concentration of these leveling agents and co-brighteners may range from about 0.5 to 5 g/l in the electroplating bath.

The pH of the electroplating bath should be between about 4 and 7 and is preferably between about 5 and 6.5, most preferably between about 5.5 and 6.5. The electroplating bath can operate at temperatures from about room temperature (70° F.) to 110° F., but is preferably operated at from about 70° F. to 95° F. Increasing the temperature of the bath generally increases the plating efficiency of the bath. Therefore, since the plating bath of this invention is capable of plating smooth, adherent electrodeposits at plating temperatures up to about 110° F., it is capable of effectively plating in a more efficient manner than other known plating solutions.

The inventor has found that electroplating baths made in accordance with this invention are useful for plating at a wide range of current densities. The plating bath can effectively operate at plating current densities from about 10–300 ASF but preferably operates at from about 50–250 ASF.

As noted, the electroplating bath of this invention is particularly suited to plating tin-zinc alloy electrodeposits. Electrodeposits of approximately 75% tin and 25% zinc are widely used in industry in improving the corrosion resistance of steel substrates. An elemplary formulation for producing 75/25 tin-zinc electrodeposits is as follows:

| Component | Concentration |
|---|---|
| Stannous Sulfate | 30–50 g/l (as tin) |
| Zinc Sulfate | 20–40 g/l (as zinc) |
| Citric Acid | 25–150 g/l |
| Ammonium Sulfate | 50–150 g/l |
| propanedioic acid diethyl ester polymer with N-(3-aminopropyl)1,3-propanediamine N-(2-carboxybenzoyl) | 0.5–1.5 g/l |
| Diglycidyl Polyethylene Glycol | 0.5–1.5 g/l |
| Polyglycerine | 0.5–1.5 g/l |
| Veratryl aldehyde | 0.05–0.5 g/l |

The inventor has found that the foregoing formulation is capable of delivering a 75/25 tin-zinc alloy (±5%) electrodeposit over a plating current density range of 50 to 300 amps per square foot (ASF) with bright, smooth electrodeposits over steel substrates. In this case the cathode would be a steel substrate and the anode would consist of a combination of tin and zinc substrates.

This invention is further described by the following example which should be taken as illustrative only and not limiting in any way.

EXAMPLE I

The following tin-zinc electroplating bath was formulated:

| Component | Concentration |
|---|---|
| Stannous Sulfate | 40 g/l (as tin) |
| Zinc Sulfate | 30 g/l (as zinc) |
| Citric Acid | 65 g/l |
| Tartaric Acid | 22.5 g/l |
| Ascorbic Acid | 9 g/l |
| Ammonium Sulfate | 100 g/l |
| Diglycidyl Polyethgyene Glycol | 1.2 g/l |
| Polyglycerine | 1.0 g/l |
| Veratryl aldehyde | 0.55 g/l |
| Propanedioic acid diethyl ester polymer with N-(3-aminopropyl)1,3-propanediamine N-(2-carboxybenzoyl) molecular weight of 700–800. | 0.6 g/l |

The foregoing electroplating bath was used to plate steel substrates with bright, smooth 75/25 tin-zinc alloy electrodeposits over a plating current density of from 50–300 ASF. The tin content of the electrodeposit varied by only about ±5% over the range of plating current densities. The foregoing electroplating bath was separately operated at 5 amps for 1 minute at room temperature and at 40° C. and was determined to be 60% and 90% efficient respectively.

What is claimed is:

1. An electroplating bath comprising a brightener additive with the following structure:

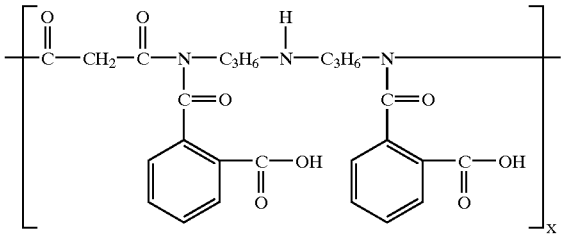

wherein X is an integer from 3 to 6.

2. An electroplating bath according to claim 1 also comprising metal ions selected from the group consisting of zinc ions, stannous tin ions, and combinations of the foregoing.

3. An electroplating bath according to claim 1 also comprising carboxylic acid.

4. An electroplating bath according to claim 1 also comprising an ammonium salt.

5. An electroplating bath according to claim 1 also comprising an aldehyde.

6. An electroplating bath according to claim 1 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

7. An electroplating bath according to claim 1 wherein the pH of the bath is between about 5 and 6.5.

8. An electroplating bath according to claim 2 also comprising carboxylic acid.

9. An electroplating bath according to claim 2 also comprising an ammonium salt.

10. An electroplating bath according to claim 2 also comprising an aldehyde compound.

11. An electroplating bath according to claim 2 wherein the bath comprises a material selected from the group consisting of stannous sulfate, stannous methane sulfonate, zinc sulfate, zinc chloride, and mixtures of the foregoing.

12. An electroplating bath according to claim 2 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

13. An electroplating bath according to claim 2 wherein the pH of the bath is between about 5 and 6.5.

14. An electroplating bath according to claim 3 wherein the carboxylic acid is selected from the group consisting of citric acid, tartaric acid, gluconic acid, ascorbic acid and mixtures of the foregoing.

15. An electroplating bath according to claim 3 comprising an ammonium salt.

16. An electroplating bath according to claim 3 comprising an aldehyde compound.

17. An electroplating bath according to claim 3 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

18. An electroplating bath according to claim 3 wherein the pH of the bath is between about 5 and 6.5.

19. An electroplating bath according to claim 4 wherein the ammonium salt is ammonium sulfate.

20. An electroplating bath according to claim 4 also comprising an aldehyde compound.

21. An electroplating bath according to claim 4 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

22. An electroplating bath according to claim 4 wherein the pH of the bath is between about 5 and 6.5.

23. An electroplating bath according to claim 5 wherein the aldehyde compound is selected from the group consisting of formaldehyde, acetaldehyde, propionaldehyde, glyoxal, succindialdehyde, caproaldehyde, veratrylaldehyde, anisaldehyde, piperonal, vanillin, and mixtures of the foregoing.

24. An electroplating bath according to claim 5 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

25. An electroplating bath according to claim 5 wherein the pH of the bath is between about 5 and 6.5.

26. An electroplating bath according to claim 8 also comprising an ammonium salt and an aldehyde compound.

27. An electroplating bath according to claim 26 also comprising a co-brightener selected from the group consisting of polyethylene glycols, water soluble polyproplylene oxide polymers, water soluble polyethylene oxide polymers, bis-phenol ethoxylates, alcohol ethoxylates, aromatic ethoxylates, ethoxylated fatty acids, ethoxylated fatty amides, ethoxylated fatty amines, polygylcerines, surfactants and combinations of the foregoing.

28. An electroplating bath according to claim 26 wherein the pH of the bath is between about 5 and 6.5.

29. An electroplating bath according to claim 27 wherein the pH of the bath is between 5 and 6.5.

30. An electroplating bath according to claim 29 wherein the co-brightener is selected from the group consisting of diglycidyl polyethylene glycol, polyglycerine, bis-phenol ethoxylates and mixtures of the foregoing.

31. An electroplating bath comprising:

a). metal ions selected from the group consisting of zinc ions, stannous tin ions, and combinations of the foregoing:

b). carboxylic acid;

c). an aldehyde compound; and d). a brightener additive with the following structure:

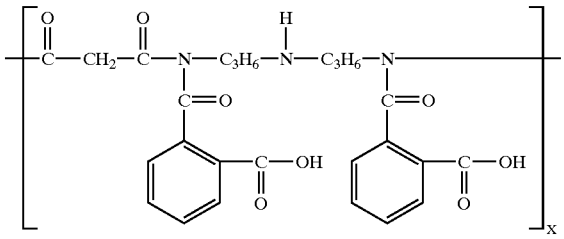

wherein X is an integer from 3 to 6.

32. An electroplating bath comprising:

a). metal ions selected from the group consisting of zinc ions, stannous tin ions, and combinations of the foregoing;

b). carboxylic acid;

c). an aldehyde compound; and d). a polymer of propanedioic acid, diethyl ester with N-(3-aminopropyl)-1,3-propanediamine, N-(2-carboxybenzoyl).

* * * * *